US011590546B2

(12) United States Patent
Willdonner

(10) Patent No.: US 11,590,546 B2
(45) Date of Patent: Feb. 28, 2023

(54) METHOD FOR FORMING A MOULDING AND MOULDING

(71) Applicant: NEUMAN ALUMINIUM FLIESSPRESSWERK GMBH, Marktl (AT)

(72) Inventor: Johann Willdonner, Hohenberg (AT)

(73) Assignee: NEUMAN ALUMINIUM FLIESSPRESSWERK GMBH, Marktl (AT)

( * ) Notice: Subject to any disclaimer, the term of this patent is extended or adjusted under 35 U.S.C. 154(b) by 565 days.

(21) Appl. No.: 16/485,297

(22) PCT Filed: Jan. 26, 2018

(86) PCT No.: PCT/EP2018/051989
§ 371 (c)(1),
(2) Date: Aug. 12, 2019

(87) PCT Pub. No.: WO2018/145926
PCT Pub. Date: Aug. 16, 2018

(65) Prior Publication Data

US 2019/0374988 A1 Dec. 12, 2019

(30) Foreign Application Priority Data

Feb. 13, 2017 (DE) ..... 10 2017 001 384.5

(51) Int. Cl.
*B21C 23/18* (2006.01)
*B21K 21/06* (2006.01)
(Continued)

(52) U.S. Cl.
CPC ..... *B21C 23/183* (2013.01); *B21C 23/03* (2013.01); *B21C 23/145* (2013.01); *B21K 21/06* (2013.01); *B21C 23/01* (2013.01)

(58) Field of Classification Search
CPC ..... B21C 23/01; B21C 23/03; B21C 23/20; B21C 23/145; B21C 23/186
See application file for complete search history.

(56) References Cited

U.S. PATENT DOCUMENTS 1,756,416 A 4/1930 Woodhead
3,096,579 A 7/1963 Waller
(Continued)

FOREIGN PATENT DOCUMENTS

CN 102319757 A 1/2012
CN 103691751 A 4/2014
(Continued)

OTHER PUBLICATIONS

Xia, Yang; "Impact Extrusion Press;" Apr. 29, 2014. Youtube. URL: https://www.youtube.com/watch?v=K7SSpV5ldL8 (Year: 2014).*
(Continued)

*Primary Examiner* — Shelley M Self
*Assistant Examiner* — Katie L. Parr
(74) *Attorney, Agent, or Firm* — Lucas & Mercanti, LLP; Klaus P. Stoffel

(57) ABSTRACT

A shaped part and a method for forming the shaped part from a lightweight metal or alloy by extrusion of a slug performed along a pressing axis. The shaped part is formed in at least one region with a deviation from a basic form that is rotationally symmetrical with respect to the pressing axis. The symmetry-deviating region extends over a wall portion of the shaped part that is formed by backward cup extrusion with a normal vector extending predominantly orthogonally in relation to the pressing axis. The same extruding operation forms a structure that surrounds the pressing axis, on a sheet-like base of the shaped part that adjoins the wall portion and has a normal vector extending predominantly in the direction of the pressing axis on the side thereof opposite
(Continued)

from the wall portion. In a region of lowest wall thickness of the wall portion at the transition to the base, the quotient of this wall thickness in mm and an average curvature (1/r) in $mm^{-1}$, formed at the transition, is greater than 0.03 and/or, in an at least predominant region of the base-wall transition when seen in the circumferential direction, the ratio of the wall thickness to the base thickness is less than 1.0.

40 Claims, 4 Drawing Sheets

(51) Int. Cl.

| | |
|---|---|
| ***B21C 23/03*** | (2006.01) |
| ***B21C 23/14*** | (2006.01) |
| ***B21C 23/01*** | (2006.01) |

(56) References Cited

U.S. PATENT DOCUMENTS 4,166,373 A * 9/1979 Braun ..... B21C 23/03 470/16
4,945,749 A * 8/1990 Walker ..... B21C 23/03 72/356
6,266,878 B1 * 7/2001 Durkin ..... B21C 23/186 29/888.043
2003/0196468 A1 * 10/2003 Ando ..... B21C 23/20 72/353.2

FOREIGN PATENT DOCUMENTS

| | | | | |
|---|---|---|---|---|
| DE | 1256518 B | | 12/1967 | |
| FR | 1599466 A | * | 7/1970 | ..... B21C 23/03 |
| GB | 2527203 A | * | 12/2015 | ..... B21C 23/22 |

OTHER PUBLICATIONS

"Impact Extrusion" Mar. 30, 2016. "The Library of Manufacturing" URL: https://thelibraryofmanufacturing.com/impact_extrusion.html#:~:text=In%20forward%20impact%20extrusion%2C%20metal,that%20the%20force%20is%20delivered. (Year: 2016).*
Database WPI, Week 201434, Thomson Scientific, London, GB; AN 2014-K09201, XP002780101.
Database WPI, Week 201212, Thomson Scientific, London, GB; AN 2012-B63237, XP002780102.
English Translation of IPRP in PCT/EP20181051989, dated Mar. 13, 2019, 9 Pages.

* cited by examiner

METHOD FOR FORMING A MOULDING AND MOULDING

The present application is a 371 of International application PCT/EP2018/051989, filed Jan. 26, 2018, which claims priority of DE 10 2017 001 384.5, filed Feb. 13, 2017, the priority of these applications is hereby claimed and these applications are incorporated herein by reference.

BACKGROUND OF THE INVENTION

The invention refers to a method for forming a moulding from a light metal or a light metal alloy by extrusion of a slug carried out along a press axis, as well as mouldings produced with it and combination components formed from it.

Extrusion is a known solid forming process, in which the material to be formed, which is in the form of a slug, is made to flow in an extrusion press under the effect of high pressure and is put into the form that determines the moulding by the shape of the extrusion press.

Because of the high pressures that may be achieved, forming may also take place at room temperature (cold extrusion), that is to say the slugs do not necessarily have to be brought up to temperatures of between 200° and 800°, depending on the material, before the pressing process.

Extrusion may best be used for producing mouldings with a rotationally symmetrical basic form with reference to the press axis. Therefore one of the main problems when producing mouldings by means of extrusion is the limited possibility of geometric form, provided sufficiently good mechanical material properties are to be achieved over the whole cross section of individual parts, such as wall parts for instance. Problems possibly occurring, for load bearing parts and/or parts under intense mechanical stress for example, may be seen in impairments to the microstructure of the material for instance, such as in the form of grooves or indentations on the surface, which particularly with changing tensile stresses may lead to fatigue fractures.

SUMMARY OF THE INVENTION

The task of the invention is based on producing mouldings with methods of this type that have greater variability with regard to their basic form with material quality that is still satisfactory.

This task is carried out with regard to the method by developing a method of the type indicated at the beginning, which essentially is characterised in that in at least one area the moulding is formed with a deviation from a rotationally symmetrical basic form with reference to the press axis, this symmetrically deviating area extends over a wall section of the moulding formed by indirect cup extrusion or indirect hollow extrusion, with normal vector running predominantly orthogonally to the press axis, and in the same extrusion process a structure running round the press axis is formed by direct cup extrusion or direct hollow extrusion on an extensive base of the moulding adjacent to the wall section, with normal vector running predominantly in the direction of the press axis, on its side opposite the wall section, in which in an area of smallest wall thickness of the wall section at the transition to the base the quotient from this wall thickness in [mm] and an average curvature in [$mm^{-1}$] formed at the transition is greater than 0.03, preferably greater than 0.1, more preferably greater than 0.3, particularly greater than 0.6 and/or, seen in the circumferential direction, in an at least predominant area of the base-wall transition the ratio of wall thickness to base thickness is less than 1.0, preferably less than 0.85, particularly less than 0.7.

The process design according to the invention makes it easier to prevent local crack initiation stresses in the flowing material occurring in the die of the extrusion press and therefore tensile stresses occurring in the material, in which the first cracks may occur, and in this way a largely homogenous microstructure and improved material quality of the moulding associated with it is achieved.

With regard to the material, according to the invention aluminium or an aluminium alloy is preferred. In a particularly preferred design an alloy with the following chemical composition in percentage by weight may be used:

Silicon 0.01 to 1.3
Magnesium 0.01 to 1.2
Manganese 0.01 to 1.0, in which the rest is formed by aluminium and impurities due to the production process.

A chemical composition in percentage by weight of

Silicon 0.01 to 0.25
Magnesium 0.01 to 0.05
Manganese 0.01 to 0.05 is also provided, in which the rest is formed by aluminium and impurities due to the production process.

In a further specified process design this quotient from wall thickness and average curvature is greater than 1/10000 of the surface of the base area measured in $mm^2$, preferably greater than 1/4000 of this surface, particularly 1/1000 of this surface. This results in good flow behaviour at the transition from the base to the wall section from the force applied by the press ram.

In absolute figures it is preferred that a round area with a length of at least 0.2 mm, preferably at least 1 mm, particularly at least 2 mm is formed in the transition area between the base and wall section or the surounding structure, in which there is a change in direction of flow of the flowing material in the process. In this way notch formations on the surface may be prevented as far as possible and the moulding becomes more resistant to material fatigue and cracks occurring also with changing mechanical stress.

In a particularly preferred embodiment the wall section is part of a wall structure running round the press axis. This makes it possible to form container-shaped mouldings. In this the method is carried out preferably in such a way that a maximum difference in height between the smallest and largest difference in the wall height of the moulding immediately after extrusion from the target geometry of the moulding to be achieved after processing is less than 3 mm, particularly less than 2 mm. Excessive earring formation is prevented through this and there may also be a saving of material.

In a useful process design the contour of the wall structure deviates predominantly and particularly completely from a rotationally symmetrical basic form with reference to the press axis and is particularly polygonal in form. Though rather unsuitable for technical extrusion reasons because of the deviation from rotational symmetry, yet this variation makes it possible to have greater variability for situations where mouldings of this type are used.

In a possible embodiment the basic form of the base and/or the contour of the wall structure is/are symmetrical with reference to at least one, preferably at least two, particularly at least four axes of symmetry. This makes it possible to have a good compromise with regard to intrinsic advantages of extrusion and the variability in application of the mouldings indicated above.

In a preferred process design the basic form of the slug essentially matches the basic form of the base. Although the simplest way of providing a slug is as a rotationally symmetrical disc, the form adapted to the basic form of the base has advantages in the extrusion behaviour of the extruded slugs, which outweigh the additional cost necessary for providing them.

In a particularly preferred embodiment a continuous surface area is formed at the side of the base in the direct extrusion direction, which extends over at least 70%, preferably at least 80% of the base surface less the surface of the surrounding structure and in which relative surface unevenness in the form of a difference in height level of the surface is less than 20%, preferably less than 10%.

In a particularly preferred process design over at least 80% of the circumference a wall thickness of the wall structure has less than 8%, preferably less than 4%, particularly less than 2% relative deviation from each other and/or, seen over the circumference, the quotient from maximum wall thickness and minimum wall thickness is less than 3.6, preferably 3.2, particularly 2.8. Through this at least predominantly a more even flow of material is also achieved in the direction contrary to the pressing direction of the ram of the extrusion press used. It is also provided that over at least 80% of the circumference, preferably over at least 90% of the circumference one or several mechanical properties from tensile strength, compressive strength, hardness and density differ by less than 8%, preferably less than 4%, particularly less than 2%. This increases the reliability of the mouldings in use.

In this context it is also provided that values in the range from 30 to 80 HB are provided over the cross section for material hardness. These values prove good with regard to the largely homogenous microstructure, which also brings advantages with reference to mechanical properties.

In a possible process design a forming tool closed on one side, preferably on two sides is used. Though particularly with the last variation this requires very precise matching of the slug volume used to the end form intended, yet advantages result with regard to savings in possible later subsequent machine processing of the moulding.

In a particularly preferred embodiment one or several particularly pin-type form elements are formed by indirect solid extrusion on the base on the side of the wall section, particularly decentralised from the middle of the base. The form elements allow the interior enclosed by the wall structure to be designed with regard to technical functionalities intended and the flexibility of the mouldings produced in use is increased through this. It is provided particularly that the pin-type form elements have a ratio of length to diameter greater than 1.2, particularly greater than 1.6, more preferably greater than 2.0. There may be technical functionality particularly also in connecting to further mouldings and/or other structures.

Usefully the slug and/or working surfaces of the extrusion press carrying out extrusion are provided with lubricants. These may be zinc-rich soaps. This makes forming easier and also increases the life of the extrusion press because of friction-reduced flow.

In a particularly preferred embodiment several of the same type of these mouldings are produced at intervals of less than 2 s, particularly less than 1.3 s, particularly less than 0.7 s. A large number of identical mouldings may be produced in a comparatively short time in this way. Preferably an extrusion press of the toggle press type is used in this and also preferably a cold extrusion press.

In a particularly preferred embodiment it is provided that, seen in the direction of the press axis, the wall structure and the surrounding structure are aligned with each other. This allows the parts to be connected to each other or similar mouldings according to the modular principle.

For numerous applications the moulding should have smooth structural elements, which may be achieved particularly easily by subsequent processing, subsequent machine processing by milling and/or drilling for example. Undesirable earring formations remaining may also be removed in a suitable way there if necessary.

With regard to the absolute size of the mouding, the invention may be used particularly advantageously with base surfaces in the range from $(10\ mm)^2$ to $(100\ mm)^2$. A wall thickness of the wall section or the wall structure preferably is in the range greater than 0.5 mm, particularly greater than 1.0 mm to 10 mm, preferably only to 7 mm, particularly only to 4 mm.

As already said, it is provided that a flow of the material is kept below local crack initiation stresses in the extrusion process. That is to say the material flowing under pressure in the cavties formed between joint parts of the forming tool is formed below local crack initiation stresses, in which this is defined by the tensile stress in the material, at which the first cracks occur.

The invention also provides a method for producing a combination component formed from two mouldings, particularly consisting of the same light metal or the same light metal alloy, in which a first moulding is formed according to a method according to the aspects indicated above and a second moulding deviating from the first moulding, particularly in its form, particularly also is formed according to a method according to the aspects explained above and in which the first and the second moulding are designed for connecting to each other, arranged one behind the other in the direction of the press axis. Through this it becomes possible to "close" mouldings by the other moulding acting as a lid for example. For connecting the mouldings preferably they may be welded and have the relevant connecting areas made weldable for this. Through this gastight containers for example may also be formed from the two mouldings. Therefore preferably it is provided that in the connected state the first and second moulding delimit a cavity and, apart from access points provided, the cavity is sealed tight, particularly gas tight. Access points may be made by drilling into the wall structure or base for example.

Extruded mouldings made of a light metal or a light metal alloy are also protected by the invention accordingly, which essentially are characterised in that in at least one area the moulding is formed with a deviation from a rotationally symmetrical basic form with reference to the press axis, this symmetrically deviating area extends over a wall section of the moulding formed by indirect cup extrusion or indirect hollow extrusion, with normal vector running predominantly orthogonally to the press axis, and a structure running round the press axis, formed by direct cup extrusion or hollow direct extrusion, is formed on an extensive base of the moulding adjacent to the wall section, with normal vector running predominantly in the direction of the press axis, on its side opposite the wall section, in which in an area of smallest wall thickness of the wall section at the transition to the base the quotient from this wall thickness in [mm] and an average curvature in $[mm^{-1}]$ formed at the transition is greater than 0.03, preferably greater than 0.1, more preferably greater than 0.3, particularly greater than 0.6 and/or, seen in the circumferential direction, in an at least predominant area of the base-wall transition the ratio of wall thickness to base thickness is less than 1.0, preferably less than 0.85, particularly less than 0.7.

The advantages of mouldings of this type result from the above explanation regarding the process aspects.

Therefore it is further provided that the moulding has one or several form characteristics, which result from process steps in its production according to a method according to one or several of the process aspects indicated above.

A combination component is further protected, particularly produced according to one of the process aspects explained above for producing a combination component formed from two mouldings, which particularly consist of the same light metal or the same light metal alloy, in which a first moulding is formed according to one of the aspects indicated above and a second moulding deviates from the first moulding, particularly in its form, and particularly also is formed as a moulding according to the aspects indicated above, in which the first and second moulding are designed for connecting to each other, arranged one behind the other in the direction of the press axis.

For certain applications it may prove advantageous to deviate from the ratio of wall thickness to base thickness (<1.0) explained above and rather to set this ratio differently again in a predominant area in the circumferential direction, that is to say greater than 1.0, preferably 1.25, also 1.5, but preferably less than 3.0, particularly 2.5. This variation is seen as advantageous particularly in combination, if the height of the wall section, particularly the surrounding wall structure, over the base is not more than 3 times, preferably not more than 2.5 times, particularly not more than 2 times higher than its wall thickness. For this design it may prove advantageous for preventing fold formations, if the fibre tool is closed at least on one side so that a counter pressure for the flowing material is built up.

BRIEF DESCRIPTION OF THE DRAWING

Further characteristics, details and advantages of the invention result from the following description with reference to the enclosed figures, in which.

DETAILED DESCRIPTION OF THE INVENTION

Figure 1:
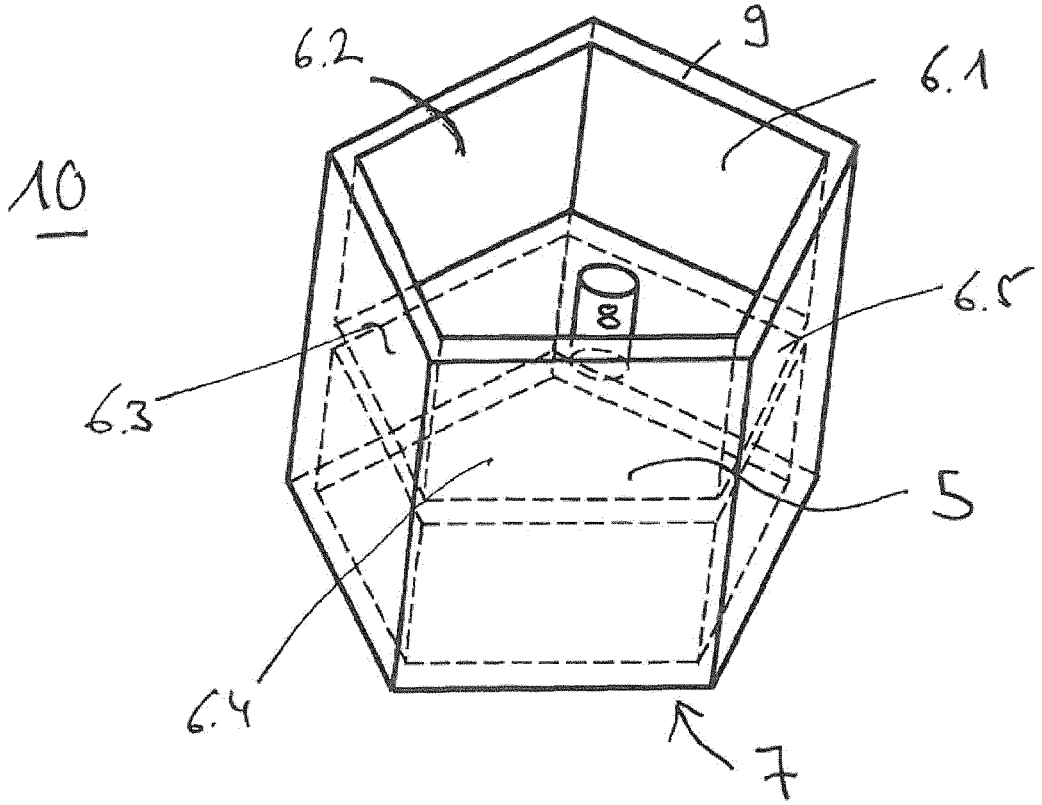
FIG. 1 shows a moulding produced by extrusion diagrammatically.

In FIG. 1 a moulding 10, which was produced by extrusion, is shown in a perspective diagrammatic view. About halfway up in the direction of the press axis a base 5 may be seen, which has a polygonal form, here the form of a pentagon, and it is also described as a floor in the following. However, other forms instead of the pentagonal form could also be used, particularly those that have axes of symmetry.

The structure that is above the floor 5 in FIG. 1 is formed by indirect cup extrusion and has a wall section 6.1, as well as further wall sections 6.2, 6.3, 6.4 and 6.5 in this embodiment, which together form an upper wall structure 6.

The arrangement formed below the floor 5 in FIG. 1 is a surrounding structure 7, which in this example embodiment corresponds to the wall structure 6 in its form. In the embodiment illustrated the floor 5 is about halfway up the moulding 10, but its position could also be asymmetric, therefore higher or lower than illustrated in FIG. 1.

A pin part 8, which is formed by indirect solid extrusion, extends decentralised from the floor 5 in an upward direction. The pin 8, as well as further pins that may be provided if necessary, are an example of the design of a structure within the cavity enclosed by the wall structure 6.

Not illustrated in FIG. 1 is a relative, though also small difference in height on the top edge 9, that is to say a small earring formation in the form of a higher wall height in the middle of the relevant wall section 6.1, which exists immediately after extrusion. Rather the top edge 9 is illustrated at the same height, produced by a milling process carried out after the extrusion process for example. Naturally further structures may be incorporated into the moulding shown in FIG. 1 by subsequent milling or drilling processing, such as grooves, holes, steps and through holes for instance. The surface on the underside of the floor 5 in this embodiment is made flat according to a preferred embodiment and, apart from the surrounding wall structure, represents a flat surface.

It may be seen that in the viewing direction of the extrusion press axis the wall structure 6 and the surrounding structure 7 are aligned with each other. Therefore the moulding shown in FIG. 1 is suitable for being fitted together with a similar moulding into a combination component. For this a welded connection may be produced permanently between (in the case of identical components) the top edge 9 of a first component and the bottom edge of the other component for example. Therefore the container interior formed through this may also be sealed tight, particularly gas tight.

Figure 2:
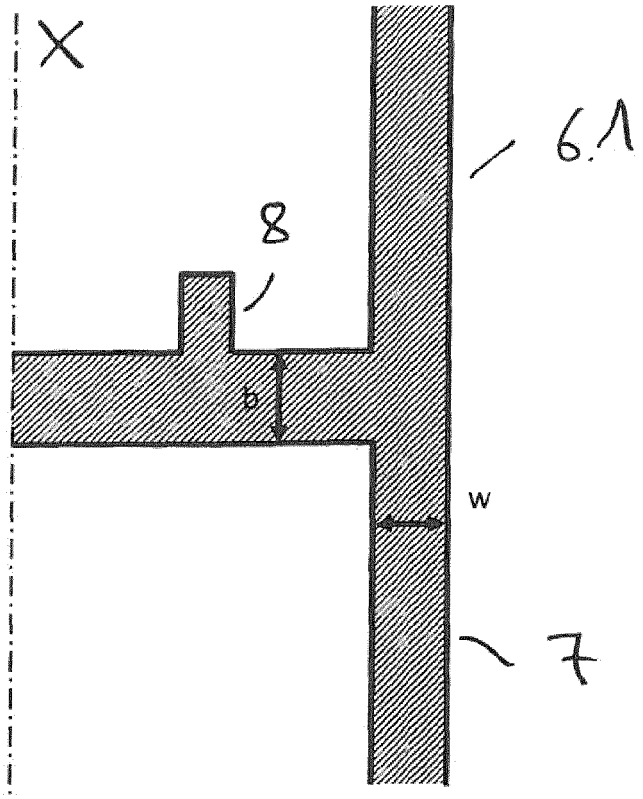
FIG. 2 shows a diagrammatic illustration of a part of an axial section through the moulding shown in FIG. 1

In the view in FIG. 2, in which a curve provided in the transition area between the floor 5 and wall section 6.1 or the surrounding structure 7 is not illustrated in any case, it may be seen that the wall thickness w is selected smaller than the floor thickness b. When extruding the moulding this results in a more uniformly directed flow of the material and great homogeneity of the wall structure 6 and also the surrounding structure 7 due to this.

Figure 3:
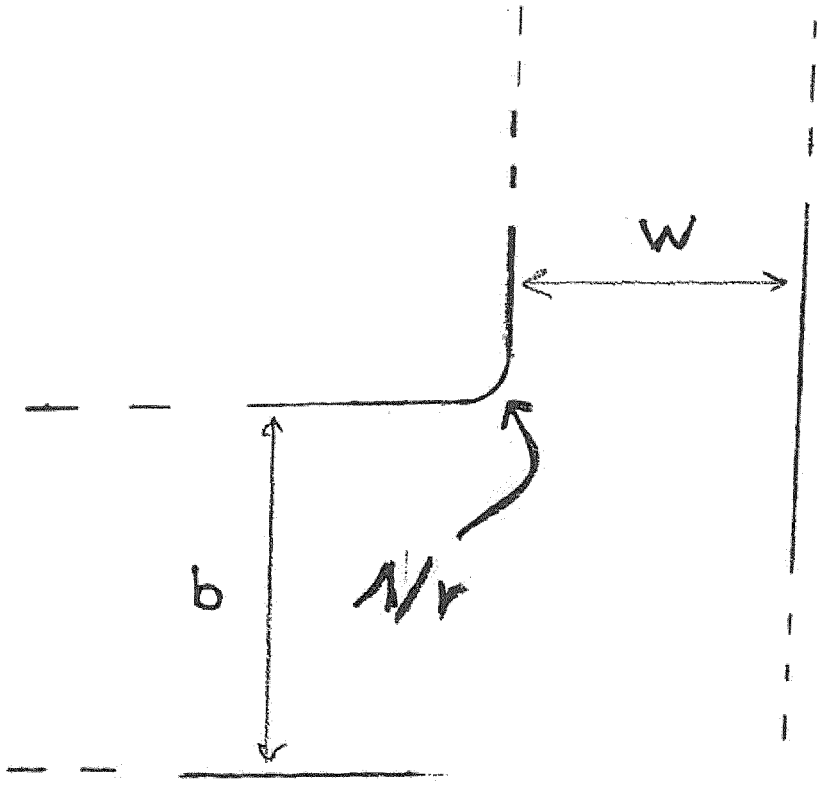
FIG. 3 shows a transition area between a wall section and a base of a moulding, and FIG. 4 schematically shows a combination component formed from two mouldings with a cavity therebetween.
Figure 4:
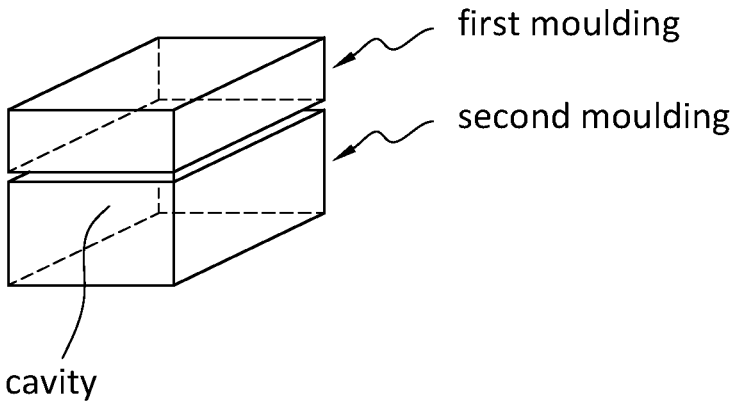

In FIG. 3 the transition from floor 8 to wall section 6.1 is represented again diagrammatically with a curve and its radius of curvature r. The ratio from the wall thickness w in [mm], here 2, and the average curvature 1/r in [$mm^{-1}$] formed at the transition, here 1/0.35, is 0.7 in the example illustrated.

The invention is not limited to the embodiment shown in the example explained above. Rather the characteristics of the following claims as well as the above description may be essential for the invention in its various embodiments.

The invention claimed is:

1. A method for forming a moulding from a light metal or a light metal alloy by impact extrusion of a slug carried out along a press axis, wherein the moulding is formed with a deviation from a rotationally symmetrical basic form with reference to the press axis by having a wall structure with a polygonal contour running around the press axis, said wall structure of the moulding being formed by indirect cup extrusion and having a normal vector running predominantly orthogonally to the press axis, and in the same impact extrusion process a surrounding structure running around the press axis is formed by direct cup extrusion, direct hollow extrusion or direct solid extrusion on an areal base of the moulding adjacent to the wall section, said areal base having a normal vector running predominantly in the direction of the press axis, said surrounding structure being on the side of the areal base side opposite the wall section, wherein in an area of smallest wall thickness of the wall section at the transition to the base a quotient of the wall thickness in divided by an average curvature in formed at the transition is greater than 0.03 and/or, seen in the circumferential direction, in an at least predominant area of the base-wall transition the ratio of wall thickness to base thickness is less than 1.0, wherein at least one pin is formed by solid extrusion on the areal base decentralized from a middle of the areal base.

2. The method according to claim 1, wherein the quotient is greater than 1/10000 of the surface of the base area measured in $mm^2$.

3. The method according to claim 1, wherein the basic form of the areal base and/or the contour of the wall structure is/are symmetrical with reference to at least one axis of symmetry.

4. The method according to claim 1, wherein a contour form of the slug matches a contour of the areal base.

5. The method according to claim 1, wherein over at least 80% of the circumference a wall thickness of the wall structure has less than 8% relative deviation from each other and/or, seen over the circumference, a maximum wall thickness divided by a minimum wall thickness is less than 3.6.

6. The method according to claim 1, wherein a forming tool closed on one side is used.

7. The method according to claim 1, wherein the slug and/or working surfaces of an impact extrusion press carrying out said impact extrusion are provided with lubricant.

8. The method according to claim 1, wherein several of the same type of these mouldings are produced at intervals of less than 2 s.

9. The method according to claim 1, wherein, seen in the direction of the press axis, the wall structure and the surrounding structure are aligned with each other.

10. The method according to claim 1, wherein subsequent processing of the moulding is carried out following the impact extrusion.

11. A method for producing a combination component formed from two mouldings, consisting of the same light metal or the same light metal alloy, in which a first moulding is formed according to the method in claim 1 and a second moulding deviating from the first moulding, and in which the first and second moulding are designed for connecting to each other, arranged one behind the other in the direction of the press axis.

12. The method according to claim 11, wherein the relevant connecting area is made weldable.

13. The method according to claim 10, wherein in the connected state the first and second moulding delimit a cavity and, apart from access points provided, the cavity is sealed tight.

14. An impact extruded moulding made of a light metal or a light metal alloy, wherein the moulding is formed with a deviation from a rotationally symmetrical basic form with reference to a press axis by having a wall structure with a polygonal contour around the press axis, said wall structure of the moulding being formed by indirect cup extrusion and having a normal vector running predominantly orthogonally to the press axis, and in the same impact extrusion process a surrounding structure running around the press axis is formed by direct cup extrusion, direct hollow extrusion or direct solid extrusion on an areal base of the moulding adjacent to the wall section, said areal base having a normal vector running predominantly in the direction of the press axis, said surrounding structure being on the side of the areal base opposite the wall section, wherein in an area of smallest wall thickness of the wall structure at the transition to the base a quotient of the wall thickness in mm divided by an average curvature in $mm^{-1}$ formed at the transition is greater than 0.03 and/or, seen in the circumferential direction, in an at least predominant area of the base-wall transition the ratio of wall thickness to base thickness is less than 1.0, wherein at least one pin is formed by solid extrusion on the areal base decentralized from a middle of the areal base.

15. The moulding according to claim 14, comprising further form characteristics.

16. A combination component, formed from two mouldings, which consist of the same light metal or the same light metal alloy, in which a first moulding is formed according to claim 14 and a second moulding deviates in form from the first moulding, in which the first and second moulding are designed for connecting to each other, arranged one behind the other in the direction of the press axis.

17. The method according to claim 1, wherein the quotient is greater than 0.1.

18. The method according to claim 17, wherein the quotient is greater than 0.3.

19. The method according to claim 18, wherein the quotient is greater than 0.6.

20. The method according to claim 1, wherein the ratio of wall thickness to base thickness is less than 0.85.

21. The method according to claim 20, wherein the ratio of wall thickness to base thickness is less than 0.7.

22. The method according to claim 2, wherein the quotient is greater than 1/4000 of the surface of the base area.

23. The method according to claim 22, wherein the quotient is greater than 1/1000 of the surface of the base area.

24. The method according to claim 3, wherein the basic form of the areal base and/or the contour of the wall structure is/are symmetrical with reference to at least two axes of symmetry.

25. The method according to claim 24, wherein the basic form of the areal base and/or the contour of the wall structure is/are symmetrical with reference to at least four axes of symmetry.

26. The method according to claim 5, wherein over the at least 80% of the circumference the wall thickness of the wall structure has less than 4% relative deviation from each other.

27. The method according to claim 26, wherein over the at least 80% of the circumference the wall thickness of the wall structure has less than 2% relative deviation from each other.

28. The method according to claim 5, wherein, seen over the circumference, the maximum wall thickness divided by the minimum wall thickness is 3.2.

29. The method according to claim 28, wherein, seen over the circumference, the maximum wall thickness divided by the minimum wall thickness is 2.8.

30. The method according to claim 6, wherein the forming tool is closed on two sides.

31. The method according to claim 8, in which several of the same type of these mouldings are produced at intervals of less than 1.3 s.

32. The method according to claim 31, in which several of the same type of these mouldings are produced at intervals of less than 0.7 s.

33. The method according to claim 10, wherein the subsequent processing is milling and/or drilling.

34. The method according to claim 11, wherein the second moulding deviates in form from the first moulding.

35. The method according to claim 13, wherein the cavity is sealed gas tight.

36. The moulding according to claim 14, wherein the quotient is greater than 0.1.

37. The moulding according to claim 36, wherein the quotient is greater than 0.3.

38. The moulding according to claim 37, wherein the quotient is greater than 0.6.

39. The moulding according to claim 14, wherein the ratio of wall thickness to base thickness is less than 0.85.

40. The moulding according to claim 39, wherein the ratio of wall thickness to base thickness is less than 0.7.

* * * * *